United States Patent [19]

Norman

[11] Patent Number: 4,693,265

[45] Date of Patent: Sep. 15, 1987

[54] CIGARETTE FILTER HAVING LOW VISIBLE STAINING

[75] Inventor: Alan B. Norman, Clemmons, N.C.

[73] Assignee: R. J. Reynolds Tobacco Company, Winston-Salem, N.C.

[21] Appl. No.: 864,363

[22] Filed: May 19, 1986

[51] Int. Cl.[4] ..... A24D 3/04

[52] U.S. Cl. ..... 131/340; 131/339; 131/344

[58] Field of Search ..... 131/331, 338, 339, 340, 131/341, 344

[56] References Cited

U.S. PATENT DOCUMENTS 3,039,367 6/1962 Stelzer .
3,166,079 1/1965 Williamson .
3,308,832 3/1967 Stelzer et al. .
3,703,429 11/1972 Berger et al. .
3,860,011 1/1975 Norman .
4,331,166 5/1982 Hale .
4,564,030 1/1986 Jessup et al. .

FOREIGN PATENT DOCUMENTS 2107850 9/1971 Fed. Rep. of Germany .
59-19608 2/1984 Japan .

*Primary Examiner*—V. Millin

[57] ABSTRACT

Filter cigarettes exhibiting a low amount of visible staining have a tobacco rod, an axially aligned filter element having a barrier region positioned on the back face thereof such that air and smoke traveling through the filter element exits the filter element towards the periphery thereof, and an axially aligned tubular mouthpiece element positioned in a spaced apart relationship with the filter element such that air and smoke exiting the filter element travels through the path of least resistance provided by the spaced apart region and the hollow region of the tube.

16 Claims, 1 Drawing Figure

CIGARETTE FILTER HAVING LOW VISIBLE STAINING

BACKGROUND OF THE INVENTION

This invention relates to smoking articles such as cigarettes, and in particular to smoking articles having filter elements attached thereto.

Popular smoking articles such as cigarettes have a substantially rod shaped structure and include a smokable material such as strands of tobacco surrounded by a wrapping material such as paper thereby forming a tobacco rod. It has been desirable to provide cigarettes having cylindrical filters positioned at one end thereof. Typically, filters are constructed from fibrous materials such as cellulose acetate and are attached to the tobacco rod using tipping material.

Known cigarette filter elements generally have a white color, and upon use of the cigarette such filter elements can undergo a noticeable discoloration. In particular, cigarettes having filter elements which resemble hollow tubes (e.g., as proposed in U.S. Pat. No. 3,703,429, West German Pat. No. 2,107,850, and Japanese Patent Application No. 59-196,082) can undergo an unsightly discoloration within the visible inner region of the tube.

In view of the fact that conventional cigarette filter elements tend to exhibit unsightly discoloration during use of cigarettes containing such elements, it would be highly desirable to provide a cigarette filter region which exhibits a low amount of visible discoloration upon use.

SUMMARY OF THE INVENTION

This invention relates to a filter cigarette having in combination a cylindrical rod of smokable material, a cylindrical filter element having a front face and a back face and axially aligned in an end-to-end relationship with the rod such the front face of the filter element is adjacent one end of the rod, and a cylindrical mouthpiece element having a substantially tubular shape and axially aligned in an end-to-end relationship with the filter element. During draw on the cigarette, air and smoke entering the filter element from the rod exits the opposite end of the filter element. The filter element includes a path of least resistance therethrough such that air and smoke exits the filter element at the back face thereof and in a region towards the periphery thereof. The mouthpiece element has a longitudinally extending hollow region and a circumscribing wall having a thickness such that the wall is axially aligned with the region where smoke and air exits the filter element. The mouthpiece element and the filter element are positioned in a spaced apart relationship such that substantial amounts of air and smoke exiting the back face of the filter element travels through the hollow region of the mouthpiece element.

The filter region of a cigarette of this invention exhibits a low amount of visible staining (i.e., in a region capable of being viewed by the consumer) when the cigarette is used. Additionally, the cigarettes exhibit the desirable properties of a filter cigarette. When the air and smoke from the tobacco rod exits the peripheral region of the filter element, substantial amounts thereof follow the path of least resistance provided by the spaced apart configuration of each of the filter element and the mouthpiece elements. Thus, substantial amounts of air and smoke travel through the hollow region of the mouthpiece element thereby providing less staining of the visible region of the filter and mouthpiece than if the two elements are positioned in an abutting relationship. As a result, the visible filter region of a cigarette of this invention substantially maintains its characteristic color and appearance during use.

DETAILED DESCRIPTION OF THE EMBODIMENTS

Figure 1:
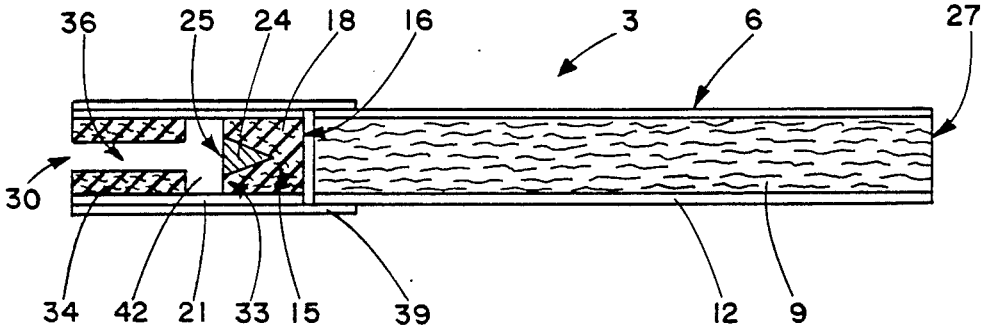
FIG. 1 is a diagrammatic cross sectional illustration of a cigarette showing the rod of smokable material, the filter element having a barrier region and the second tubular shaped element at the mouthend portion of the cigarette.

An embodiment of this invention shown in FIG. 1 is a smoking article 3 in the form of a cigarette including a generally cylindrical rod 6 of smokable material 9 contained in wrapping material 12. Cylindrical rod 6 will be referred to as a "tobacco rod." Typically, the smokable material is a charge of cured or processed tobacco, reconstituted tobacco, tobacco substitute, or blend thereof; and is provided as conventionally employed in the manufacture of cigarettes (i.e., as strands of material provided at about 32 cuts per inch and treated with flavorants and humectants). Typically, the wrapping material is a conventional cigarette wrapping paper. The wrapping material has a tubular shape so as to contain the smokable material. The size of the tobacco rod can vary, and typically ranges from about 55 mm to about 85 mm in length, and from about 20 mm to about 26 mm in circumference.

The smoking article further includes first mouthend element in the form of filter element 15 positioned adjacent to one end of the tobacco rod such that the filter element is axially aligned with the tobacco rod in an end-to-end relation. Filter element 15 has a substantially cylindrical shape, and the diameter thereof is substantially equal to that of the tobacco rod. Preferably the filter element substantially abuts the tobacco rod. For example, the front face 16 of the filter element can substantially abut the tobacco rod. The ends of the filter element permit the passage of air and smoke therethrough.

The filter element includes filter material 18 which is provided from fibrous material such as cellulose acetate or the like, and an overwrap of circumscribing wrap 21 such as air permeable (i.e., porous) paper plug wrap or substantially air impermeable (i.e., nonporous) paper plug wrap. The length of the filter element can vary, and typically ranges from about 10 mm to about 30 mm.

The filter element includes substantially smoke impervious region 24 (i.e., a barrier region) positioned near the central portion (with respect to the cross section) of the filter element and near the end of the filter element opposite that end adjacent to the tobacco rod (i.e., near the back face 25 of the filter element). Typically, the substantially smoke impervious region extends longitudinally along filter element in amount ranging from the total length of the filter element to as little as a film on the back face 25 thereof. Typically, the substantially smoke impervious region 24 covers from about 25 percent to about 50 percent of that cross sectional area of the filter element. Preferably, the substantially smoke impervious region covers the portion of the cross section of the filter element near the central region of the cross sectional area or portion of the back face of the filter element. Additionally, the barrier region preferably forms a substantially circular shape on the back face of the filter element (i.e., as would be viewed from the end of the smoking article along the longitudinal axis thereof).

The barrier region is provided by any material which can produce a substantially smoke impervious or impermeable region when positioned in contact with the filter material 18. For example, the material forming the barrier region can be an adhesive such as a water based polyvinylacetate adhesive, a hot melt adhesive such as a mixture of paraffin wax, a polyterpene and an ethylene vinylacetate resin, or other such adhesives. Such glues can be applied to the desired region on the back face 25 of the filter element 15 thereby providing impervious region 24 which is essentially positioned on the back face of the filter element. Alternatively, the barrier region can be formed from a material which dries to form a substantially smoke impervious film. For example, a mixture of cellulose acetate and acetone, or a variety of the "dopes" described in U.S. Pat. No. 3,930,077 to Levers et al can be applied to the back face of the filter element and allowed to dry to form an air impermeable barrier. Generally, any material which can adhere to or be compatible with the filter material 18 while providing the desired barrier to smoke permeability can be employed as a barrier material. Most desirably, the barrier material exhibits a color which very nearly approximates that of the first filter material (e.g., a white color).

If desired, the barrier region can be provided by a molded material such as air impermeable polypropylene, polystyrene, or the like. If desired the air impermeable material can be employed as a closed cell foam. For example, the molded material can be positioned within the filter element in order that the air and smoke passing through the filter material passes around the molded material. If desired the molded material can be in the form of a substantially air impermeable cylinder which extends over the longitudinal length of the filter element thereby providing for passage of air and smoke through the filter element in the smoke and air permeable region 33 towards the periphery of the filter element.

The barrier region is positioned such that the air and smoke traveling through the smoking article from the lit end 27 to the mouthend 30 is channeled away from smoke impervious region 24 and through smoke and air permeable region 33 near the periphery of the filter element. In particular, the air and smoke traveling through the first filter material follows the desired path of least resistance therethrough.

The smoking article further includes second element (i.e., mouthpiece element) 34 positioned adjacent to the output end (i.e., back face) of the first filter element such that the filter element 15 and the mouthpiece element are aligned in an end-to-end relation. Mouthpiece element 34 has a substantially cylindrical shape, and the diameter thereof is substantially equal to that of the tobacco rod. The mouthpiece element includes a hollow region 36 which extends along the longitudinal length thereof, thereby providing a tube-like shape thereto. The hollow region is most preferably positioned with respect to the cross section of the filter element so as to be near the central region of the cross sectional area. The hollow region most preferably has a circular cross sectional shape.

The second element or mouthpiece element 34 conveniently is provided from a fibrous material such as cellulose acetate, or the like, and an overwrap of circumscribing wrap 21. Preferably, both the first filter element and second mouthpiece element share a common wrap. Most desirably, the mouthpiece element exhibits a color which very nearly approximates that of the first filter material and the barrier material providing the barrier region. Preferably, the mouthpiece element can be provided by severing tubular rods which are manufactured as described in U.S. Pat. No. 3,095,343 to Berger.

The cross sectional area covered by the hollow region 36 relative to the total cross sectional area of the second mouthpiece element can vary. Typically the cross sectional area of the hollow area ranges from about 25 to about 50 percent of the total cross sectional area of the mouthpiece element. The thickness of the wall (i.e., the thickness of the outer most portion of the mouthpiece element surrounding the hollow region) can vary and is preferably thick enough to expose only barrier region of the filter element when the cigarette is viewed end-on. The length of the mouthpiece element can vary, and typically ranges from about 5 mm to 15 mm.

The filter element and mouthpiece element are positioned in a spaced apart relationship and attached to rod 6 by tipping material 39 which circumscribes each of the mouthpiece element 34, the airspace 42, the filter element 15, and an adjacent region of the rod. The inner surface of the tipping material is fixedly secured to the outer surface of the wrap 21 (which preferably circumscribes the mouthpiece element, the airspace and the filter material) and to the outer surface of the wrap 12 of the rod. The tipping material circumscribes the rod over a longitudinal length which can vary but is typically that length sufficient to provide good attachment of the filter region to the rod. Typically, the tipping material is either a conventional air permeable tipping material or a conventional substantially air impermeable tipping material such as tipping paper. If desired, openings such as slits, holes, or perforations in the substantially air impermeable tipping material (and underlying wrap) can provide a means for air dilution of the cigarette.

Smoke and air leaving the back face 25 of the filter element 15 is desirably routed in a pathway through the hollow center region 36 of mouthpiece element 34. A particularly convenient means for routing the smoke and air through the aforementioned hollow center region is to provide airspace 42 between the output end of the filter element and the foremost portion of the mouthpiece element. The airspace is most conveniently provided by spacing the adjacent elements apart from one another in a spaced apart relationship. Generally, the airspace extends a distance longitudinally along the smoking article over that distance sufficient for the air and smoke passing through the filter region to pass from the peripheral region of the first filter element to the hollow center region of the mouthpiece element. Preferably, the airspace extends from about 1 mm to about 10 mm, more preferably from about 1 to about 3 mm along the longitudinal length of the smoking article.

Typical pressure drop values for cigarettes of this invention are comparable to conventional cigarettes. For example, it is most desirable to employ a filter element, barrier region and mouthpiece element such that the pressure drop of the resulting cigarette ranges from about 75 mm to about 200 mm of water pressure drop at 17.5 ml/sec of air flow rate using a pressure drop tester sold commercially as Model No. FTS-300 by Filtrona Corporation.

What is claimed is:

1. A filter cigarette having in combination a cylindrical rod of smokable material, a cylindrical filter element having a front face and a back face and axially aligned in an end-to-end relationship with the rod such the front face of the filter element is adjacent one end of the rod, and a cylindrical mouthpiece element having a substantially tubular shape and axially aligned in an end-to-end relationship with the filter element;

wherein during draw, air and smoke entering the filter element from the rod exits the opposite end of the filter element;

the filter element includes a path of least resistance therethrough such that air and smoke exits the filter element at the back face thereof and in a region towards the periphery thereof;

the mouthpiece element has a longitudinally extending hollow region and a circumscribing wall having a thickness such that the wall is axially aligned with the region where smoke and air exits the filter element;

the mouthpiece element and the filter element are positioned in a spaced apart relationship such that substantial amounts of air and smoke exiting the back face of the filter element travels through the hollow region of the mouthpiece element.

2. The cigarette of claim 1 wherein the filter element comprises a cellulose acetate filter material and a circumscribing plug wrap.

3. The cigarette of claim 2 wherein the path of least resistance is provided by a substantially smoke impervious region positioned at least at the back face of the filter element and positioned near the central portion of the back face.

4. The cigarette of claim 3 wherein each of the filter material of the element, the substantially smoke impervious region and the mouthpiece element each exhibit a similar color.

5. The cigarette of claim 4 wherein the color is a white color.

6. The cigarette of claim 1 wherein the mouthpiece element is manufactured from plasticized cellulose acetate.

7. The cigarette of claim 6 wherein the longitudinally extending hollow region of the mouthpiece element extends along the longitudinal axis thereof and the cross sectional area of the hollow region ranges from about 25 to about 50 percent of the cross sectional area of the mouthpiece element.

8. The cigarette of claim 6 wherein the length of the mouthpiece element ranges from about 5 mm to about 15 mm.

9. The cigarette of claim 1 wherein the rod, the filter element and the mouthpiece element are maintained in axial alignment by tipping material which circumscribes each of the filter element, the mouthpiece element and a region of the rod adjacent the filter element.

10. The cigarette of claim 1 wherein the rod and the filter element are positioned in a substantially abutting relationship.

11. The cigarette of claim 1 wherein the spaced apart relationship of the filter element and the mouthpiece element is such that an airspace is formed therebetween which extends from about 1 mm to about 10 mm along the longitudinal length of the cigarette.

12. The cigarette of claim 1 wherein the path of least resistance is provided by a substantially smoke impervious region positioned at least at the back face of the filter element and positioned near the central portion of the back face.

13. The cigarette of claim 9 wherein the smoke impervious region forms a circular shape on the back face of the filter element.

14. The cigarette of claim 13 wherein the smoke impervious region on the back face of the filter element covers from about 25 percent to about 50 percent of the surface area of the cross sectional face.

15. The cigarette of claim 12 wherein smoke impervious region on the back face of the filter element covers a surface area of the filter element which is greater than the cross sectional area of the hollow region of the mouthpiece element.

16. The cigarette of claim 12 wherein the smoke impervious region has the form of a film on the back face of the filter element.

* * * * *

UNITED STATES PATENT AND TRADEMARK OFFICE

CERTIFICATE OF CORRECTION

PATENT NO. : 4,693,265

DATED : September 15, 1987

INVENTOR(S) : Alan B. Norman

It is certified that error appears in the above—identified patent and that said Letters Patent is hereby corrected as shown below:

In the Claims:

Column 6, line 31, Claim 13, "9" should be --12--.

Signed and Sealed this

Second Day of January, 1990

*Attest:*

JEFFREY M. SAMUELS

*Attesting Officer*

*Acting Commissioner of Patents and Trademarks*